US007208871B2

(12) United States Patent
Jonson

(10) Patent No.: US 7,208,871 B2
(45) Date of Patent: Apr. 24, 2007

(54) LUMINOUS ELEMENT HAVING ELECTRODES

(76) Inventor: Kennet Jonson, Solskensvägen 26, SE-461 59, Trollhättan (SE)

( * ) Notice: Subject to any disclaimer, the term of this patent is extended or adjusted under 35 U.S.C. 154(b) by 388 days.

(21) Appl. No.: 10/477,128

(22) PCT Filed: Apr. 17, 2002

(86) PCT No.: PCT/SE02/00754

§ 371 (c)(1),
(2), (4) Date: Apr. 12, 2004

(87) PCT Pub. No.: WO02/091804

PCT Pub. Date: Nov. 14, 2002

(65) Prior Publication Data

US 2004/0155581 A1 Aug. 12, 2004

(30) Foreign Application Priority Data

May 8, 2001 (SE) ..... 0101583

(51) Int. Cl.
*H05B 33/00* (2006.01)

(52) U.S. Cl. ..... 313/512; 313/498; 313/506

(58) Field of Classification Search ..... 313/504, 313/506, 509, 511, 512
See application file for complete search history.

(56) References Cited

U.S. PATENT DOCUMENTS

| | | | | |
|---|---|---|---|---|
| 3,052,812 | A | 9/1962 | Dow | |
| 3,069,579 | A | 12/1962 | Berg et al. | |
| 5,902,688 | A * | 5/1999 | Antoniadis et al. | 428/690 |
| 6,526,200 | B1 * | 2/2003 | Davie | 385/31 |
| 2003/0030369 | A1 * | 2/2003 | Shih et al. | 313/504 |

* cited by examiner

*Primary Examiner*—Nimeshkumar D. Patel
*Assistant Examiner*—Matt Hodges
(74) *Attorney, Agent, or Firm*—Harness, Dickey & Pierce, P.L.C.

(57) ABSTRACT

A luminous element (1) comprising a conductor (2), which is associated with an electroluminescent material (3). An electrode (4, 8, 9) is associated with said electroluminescent material and the luminous element (1) is arranged to emit light, when electric voltage is applied between the conductor (2) and said electrode (4, 8, 9). At least either the conductor (2) or the electrode (4, 8, 9) is insulated along at least a section of the luminous element (1) through the electroluminescent material (3) along said element section.

10 Claims, 4 Drawing Sheets

LUMINOUS ELEMENT HAVING ELECTRODES

TECHNICAL FIELD OF INVENTION

The present invention relates to a luminous element comprising a conductor, which is associated with an electroluminescent material. The electroluminescent material is associated with an electrode and the luminous element is arranged to emit light when an electric voltage is applied between said conductor and said electrode.

TECHNICAL BACKGROUND OF THE INVENTION

A luminous element of the kind defined in the introduction is already known. By positioning an electroluminescent material between two conductive materials, said electroluminescent material may be made to emit light when voltage is applied between the two conductive materials. For example, an electroluminescent material may be placed around a conventional electric conductor. If a second, thinner conductor, in the following referred to as an electrode, is wound around the first conductor, which is provided with an electroluminescent material, an electroluminescent wire is obtained that emits light when voltage is applied between the electrode and the conductor. For protection of the electroluminescent wire and to make the light visible, the wire conventionally is covered by a translucent, non-conductive material. This type of electroluminescent wire may be used for example to indicate emergency-exit routes in aeroplanes or buildings.

Those sections of the electroluminescent wire that are not intended to emit light are masked, or alternatively the electroluminescent wire is enclosed in a non-translucent material. Regrettably, the energy consumption is the same, irrespective of whether the electroluminescent wire is masked or not. If a pulsed voltage is applied between the conductor and the electrode, an intermittent light is emitted. By arranging several electroluminescent wires the voltages of which are pulsed in different sequences, so called walking lights may be obtained. The higher the number of functions desired, the higher the number of electroluminescent wires required, and as a consequence, the resulting construction is very ungainly.

SUMMARY OF THE INVENTION

The object of the present invention therefore is to provide a luminous element that eliminates the problems mentioned above and also in other respects offers a more flexible solution.

This object is achieved in accordance with the invention by giving the element of the kind defined in the introduction the characteristic features that appear from the appended claim 1. Preferred embodiments of the luminous element appear from the dependent claims.

The luminous element in accordance with the invention thus employs a conductor, which is associated with an electroluminescent material. The electroluminescent material is associated with an electrode and the luminous element is made to light up, when an electric voltage is applied between the conductor and the electrode. By insulating at least-either the conductor or the electrode along at least a section of the luminous element that should not emit any light, energy is saved along these insulated sections, instead of the light just being masked.

In accordance with one embodiment, the luminous element is an electroluminescent wire, the electroluminescent material of which is wound about the conductor. In turn, an electrode is wound about the electroluminescent material. In the sections of the electroluminescent, from which no light-emission is desired, either the conductor or the electrode is insulated. For ease of manufacture, the most convenient is, however, to insulate the electrode.

Preferably, two or more electrodes are used, having different output voltage signals. Accordance to one example involving two electrodes, a constant fixed voltage may be applied on one of the electrodes and a pulsed voltage on the other. In the sections of the electroluminescent wire, from which a steady light is desired, consequently the electrode is insulated on which the pulsed voltage is applied. If, on the other hand a flashing light is desired, the electrode is insulated on which a constant fixed voltage is applied. In this manner, several functions may be obtained with one and the same electroluminescent wire and in this way both economy of space and of electroluminescent wire is achieved in installations. Another possible solution is to use a so called "walking" light, wherein for example three sections of the electroluminescent wire (three electrodes) emit light sequentially one after the other. In this manner, an emergency escape route may be marked in the floor and the walking light indicates the direction of exit.

When more than one electrode is used, suitably at least one of the electrodes is insulated along each section of the electroluminescent wire in order to save energy and to distinguish different signals. Additionally, when more than two electrodes are used, suitably only one of the electrodes is uninsulated along those electroluminescent-wire sections from which emission of light is desired.

Preferably, the electroluminescent wire is enclosed in a translucent material, such as plastics, that may be tinted to the desired colour for adaptation to e.g. a signal code. For fire-proof purposes, the plastics of the electroluminescent wire preferably is polytetrafluoroethylene (PTFE).

For special applications, garments are used that are provided with a built-in light to make the garment wearer visible in the dark. For example, it is sometimes important that policemen make themselves visible in the dark so that they may be seen by pedestrians and drivers. By means of an electroluminescent wire in accordance with the invention, it thus is possible to fit a jacket with cord edgings that emit light when current is supplied to the electroluminescent wire. The source of current could be a small battery, and since only certain selected sections of the electroluminescent wire are to emit light, a battery lasts for a comparatively long time. In addition, it is possible to use the electroluminescent wire as a thread that is woven into a fabric, to produce e.g. a traffic sign showing luminous symbols.

In order to increase the operational safety, a source of current suitably is arranged at each end of the electroluminescent wire. Should the electroluminescent wire break for one reason or other, both parts of the wire will continue to emit light for as long as the electroluminescent wire remains uninterruptedly connected to one of the sources of current.

In accordance with an alternative embodiment, the luminous element is an electroluminescent film, in which the conductor is spread out to form a surface element, which is covered by an electroluminescent material in at least some areas that are intended to emit light and wherein at least one electrode is associated with the electroluminescent material. By placing different series of electrodes on the electroluminescent material, different symbols may become luminous.

By means of four different series of electrodes, four different symbols may be shown with the aid of the electroluminescent film.

Preferably, a metal foil is used as the conductor. In accordance with a further variety of the present embodiment, the foil may be divided into several parts, part areas, and it becomes possible to control the current supply to the individual part area. By building up a grid pattern on the foil, symbols, letters and the like may be shown, the resolution of which corresponds to the number of squares per area unit of the grid pattern. A condition for the viability of this arrangement is that a plurality of electrodes are arranged on the opposite side of the layer of electroluminescent material.

In order to protect the film and to make the generated light visible, it is suitable to cover it with a translucent layer of for example plastics. Polytetrafluoroethylene is preferred for fireproof reasons.

BRIEF DESCRIPTION OF THE DRAWINGS

The invention will be described in the following in more detail with reference to the accompanying schematic drawing figures which for exemplifying purposes show some presently preferred embodiments of the invention. In the drawings.

DETAILED DESCRIPTION OF PREFERRED EMBODIMENTS

Figure 1:
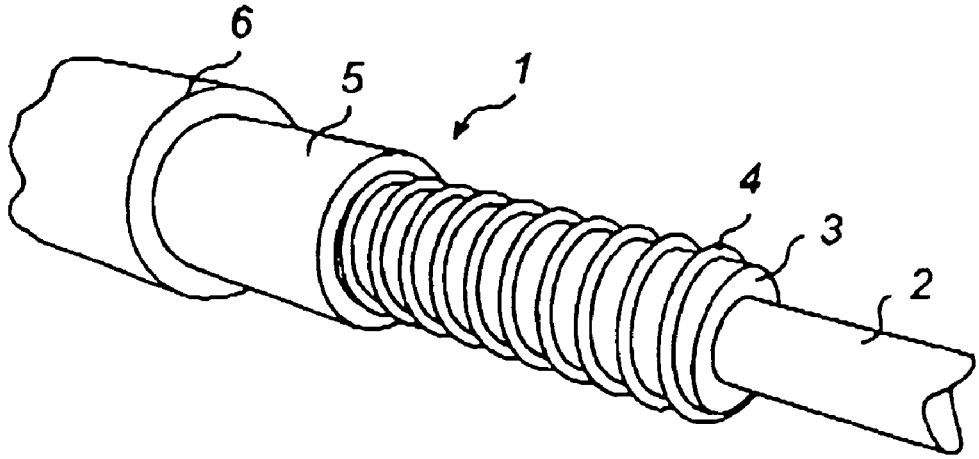
FIG. 1 is a perspective view of an electroluminescent wire in accordance with the present invention.

The electroluminescent wire shown in FIG. 1, comprises a conductor 2, an electroluminescent material 3, an electrode 4, and a protective cover 5 of polytetrafluoroethylene (PTFE). Preferably, the cover 5 is translucent. The electroluminescent wire 1 can then be positioned in a holder 6 of some kind, which likewise should be translucent. When electric voltage is applied between the conductor 2 and the electrode 4, current will pass through the electroluminescent material 3, which then emits light.

Figure 2:
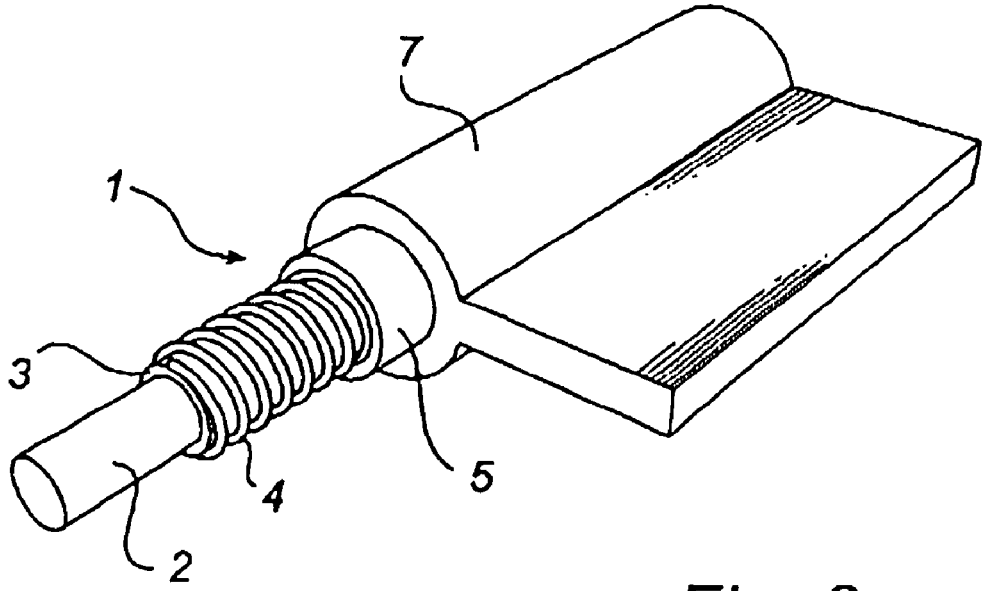
FIG. 2 is a perspective view of an electroluminescent wire fitted in a cord edging in accordance with the present invention.

FIG. 2 shows an electroluminescent wire 1 arranged in a cord edging 7. Such cord edgings 7 may be sewn for example into policemen's uniforms to allow the uniform carrier to choose when she/he wishes to be visible in the dark. Also firemen could make use of jackets fitted with light-emitting cord edgings 7, when they enter a building to extinguish a fire and it is desirable that the firemen are able to see one another.

Figure 3A:
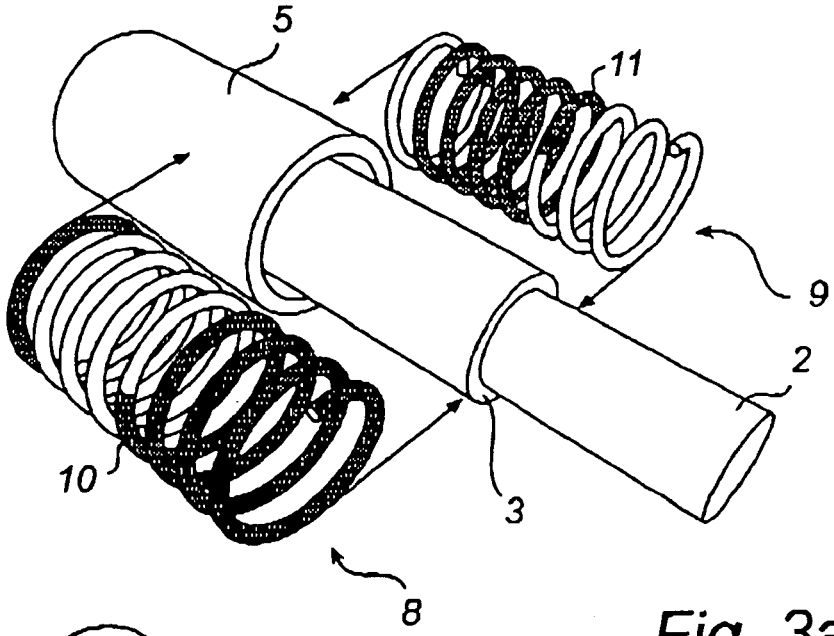
FIGS. 3*a*–3*c* show an electroluminescent wire formed with two electrodes in accordance with the present invention.
Figure 3B:
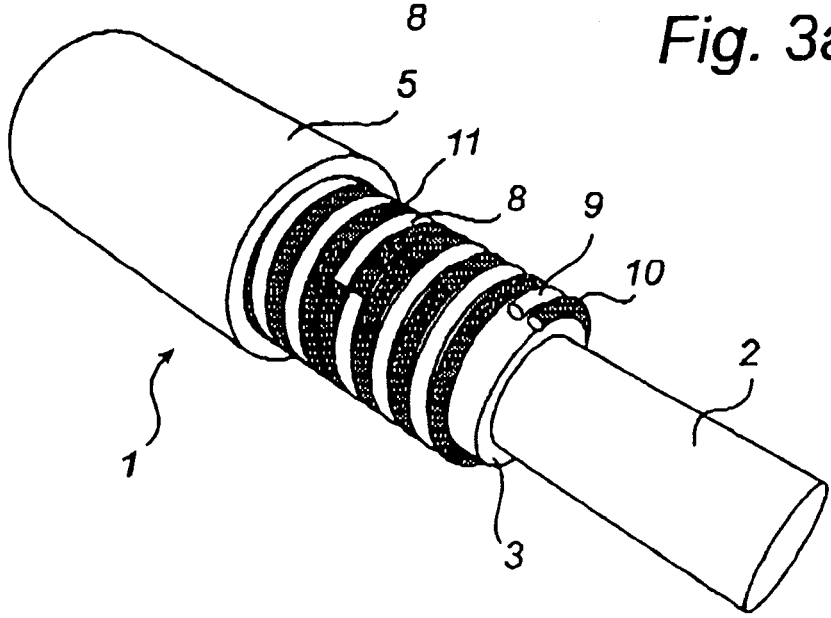
Figure 3C:
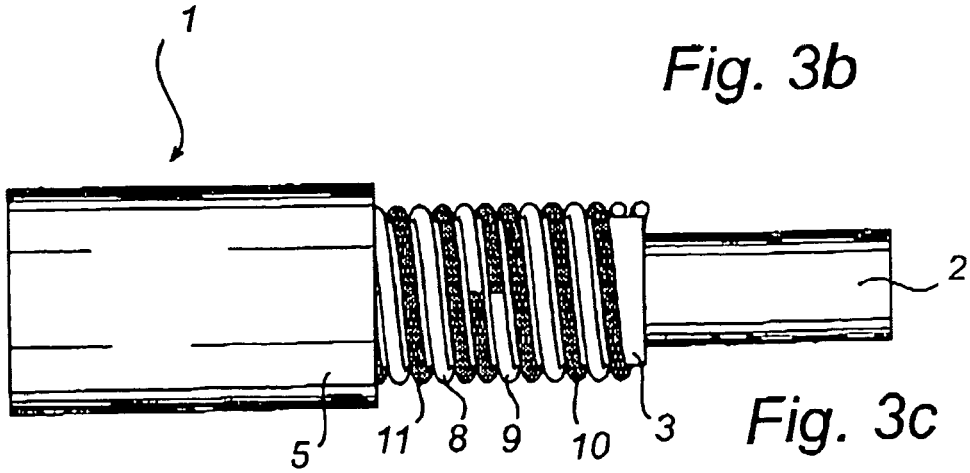

In one preferred embodiment of the invention, the electroluminescent wire is formed with two electrodes as in FIGS. 3*a*–3*c*. One 8 of the electrodes is provided with insulation 10 along those sections of the electroluminescent wire 1 where the second electrode 9 is uninsulated and reversely, the electroluminescent wire 9 is provided with insulation 11 along the sections of the electroluminescent wire 1, where the electrode 8 is uninsulated. Along the sections of the electroluminescent wire 1, from which no light-emission is desired, both electrodes 8 and 9 are insulated. If a pulsed voltage is applied on the electrode 8 and a constant voltage on the electrode 9, those sections along the electroluminescent wire 1, where the electrode 8 is uninsulated, will emit a flashing light and along the sections where the electrode 9 is uninsulated, the electroluminescent wire 1 will emit a steady light.

Figure 5:
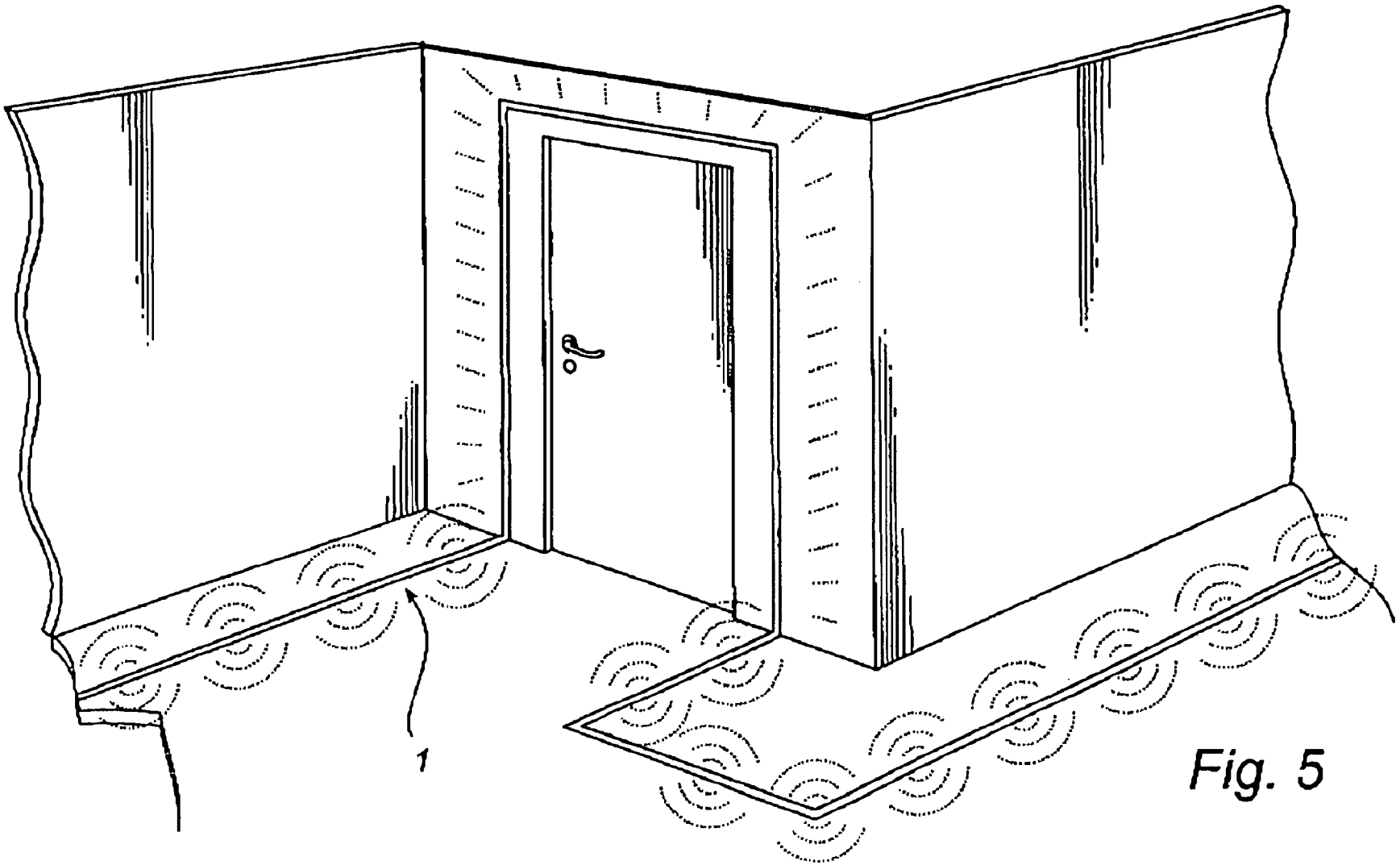
FIG. 5 shows an application of an electroluminescent wire in accordance with the present invention.

FIG. 5 shows one possible application of an electroluminescent wire in accordance with the invention. An emergency-exit route could for example be marked with a flashing light as shown in the drawing figure and the escape door with a steady light. In accordance with a preferred embodiment, the electroluminescent wire is in this case equipped with four electrodes, one of which has a constant voltage to provide the steady light around the door. On the three other electrodes pulsed voltages are applied sequentially, one after the other, in order to generate "walking" lights that mark the direction of the emergency-exit route, which in FIG. 5 corresponds to lights pointing towards the door.

Figure 4A:
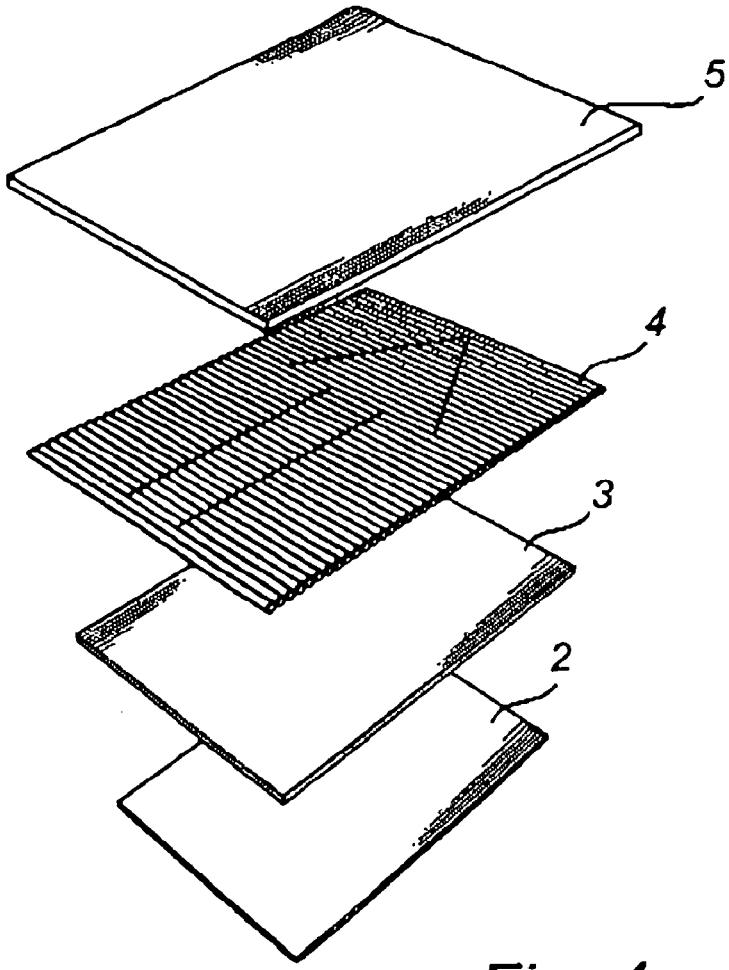
FIGS. 4*a*–4*b* show an electroluminescent film in accordance with the present invention.
Figure 4B:
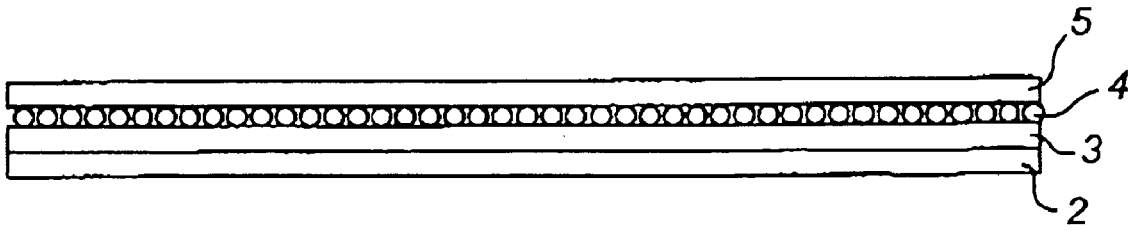

In accordance with one preferred alternative embodiment of the invention, the conductor 2 is a foil on which an electroluminescent material 3 is applied. On top of the electroluminescent material 3 a series of electrodes 4 are positioned and in order to protect the electroluminescent film, a plastics film 5 is placed on top thereof, see FIGS. 4*a* and 4*b*. For fire-safety reasons, the plastic film 5 also in this case preferably consists of polytetrafluoroethylene (PTFE). The sections of the electrodes 4 that are not insulated form a symbol, such as a letter or a shape. One example of symbols is arrows serving to indicate the direction of vehicle traffic for example in cases of temporary roadwork, see FIG. 4*a*. By arranging the electrodes in different series, several symbols may be made visible by means of the same electroluminescent film. In one electroluminescent film comprising four series of electrodes, thus four symbols may be shown, i.e. every fourth electrode belongs to the same series and these electrodes preferably are coupled in series.

In order to increase the possibility to show a larger number of symbols, the foil 2 may be divided into several square boxes or compartments (not shown), each one of which is insulated from the rest, and wherein voltage may be applied on all squares or compartments, on one or more at a time. Depending on which squares or compartments that are activated, different letters, for instance, may be built up from this system.

As should be realised, many modifications of the embodiments described in the aforegoing are possible within the scope of protection of the invention such as the latter is defined in the appended claims. As described previously the protective translucent cover could for instance be tinted for adaptation to the intended field of application. In addition, it is possible to vary the pitch of the coiling turns of the electrodes 4, 8, 9 that are wound about the electroluminescent material and the conductor. Also an electroluminescent wire 1 inserted into a cord edging 7 may be adapted to emit different lights, i.e. be fitted with more than one electrode, in order to make it possible to use it for a larger number of applications. In the embodiment using the foil 2 divided into several mutually insulated compartments or squares, the compartments or squares need not be of square configuration but would equally well be hexagonal, rectangular or have some other suitable shape.

The invention claimed is:

1. A luminous element, comprising a conductor, which is associated with an electroluminescent material, said electroluminescent material being associated with at least two electrodes and the luminous element being arranged to emit light, when electric voltage is applied between the conductor and said at least two electrodes, wherein the luminous element is an electroluminescent wire, the electroluminescent wire is formed with said at least two electrodes, the first electrode is provided with an insulation along the sections of the electroluminescent wire where the second electrode is uninsulated and reversely, the second electrode is provided with an insulation along the sections of the electroluminescent wire where the first electrode is uninsulated.

2. A luminous element as claimed in claim 1, wherein the electroluminescent material is arranged around the conductor and an electrode is wound around said electroluminescent material.

3. A luminous element as claimed in claim 2, wherein the electrode is insulated along at least a section of the electroluminescent wire.

4. A luminous element as claimed in claim 2, wherein the electroluminescent wire is enclosed in a translucent plastic.

5. A luminous element as claimed in claim 4, wherein the plastic is polytetrafluoroethylene (PTFE).

6. A luminous element as claimed in claim 2, wherein the electroluminescent wire is arranged in a cord edging.

7. A luminous element as claimed in claim 2, wherein the electroluminescent wire is arranged as a thread woven into a textile fabric.

8. A luminous element as claimed in claim 2, wherein a source of current is arranged at each end of the electroluminescent wire.

9. A luminous element, comprising a conductor which is associated with an electroluminescent material, said electroluminescent material being associated with an electrode and the luminous element being arranged to emit light when electric voltage is applied between the conductor and said electrode, wherein at least either the conductor or the electrode has at least one insulated and at least one uninsulated section of the luminous element in order to prevent light from being emitted when an electric voltage is applied between the conductor and the electrode along said insulated section, wherein the luminous element is an electroluminescent wire, and the electroluminescent material is arranged around the conductor and the electrode is wound around said electroluminescent material, and the electroluminescent wire is arranged in a cord edging.

10. A luminous element, comprising a conductor which is associated with an electroluminescent material, said electroluminescent material being associated with an electrode and the luminous element being arranged to emit light when electric voltage is applied between the conductor and said electrode, wherein at least either the conductor or the electrode has at least one insulated and at least one uninsulated section of the luminous element in order to prevent light from being emitted when an electric voltage is applied between the conductor and the electrode along said insulated section, wherein the luminous element is an electroluminescent wire, and the electroluminescent material is arranged around the conductor and the electrode is wound around said electroluminescent material, and the electroluminescent wire is arranged as a thread woven into a textile fabric.

* * * * *